US005326009A

United States Patent [19]

Kobayashi et al.

[11] Patent Number: 5,326,009

[45] Date of Patent: Jul. 5, 1994

[54] AIR NOZZLE FOR USE IN PRODUCTION OF NONWOVEN FABRIC

[75] Inventors: Yoshinori Kobayashi; Naoyuki Tamura, both of Yamaguchi; Haruo Sasako, Ichihara, all of Japan

[73] Assignee: Mitsui Petrochemical Industries, Ltd., Tokyo, Japan

[21] Appl. No.: 37,530

[22] Filed: Mar. 26, 1993

Related U.S. Application Data

[63] Continuation of Ser. No. 679,150, Mar. 28, 1991, abandoned, which is a continuation of Ser. No. 586,375, Sep. 21, 1990, abandoned, which is a continuation of Ser. No. 304,225, Jan. 31, 1989, abandoned.

[30] Foreign Application Priority Data

Feb. 15, 1988 [JP] Japan ..... 63-32418

[51] Int. Cl.[5] ..... B65H 20/14; D01G 25/00

[52] U.S. Cl. ..... 226/97; 28/271; 28/273; 57/350; 406/193

[58] Field of Search ..... 226/97, 7; 57/350; 28/271, 272, 273; 242/157 R; 406/193, 194, 195

[56] References Cited

U.S. PATENT DOCUMENTS

| | | | |
|---|---|---|---|
| 3,080,134 | 3/1963 | England et al. | 242/157 R |
| 3,080,135 | 3/1963 | Steijn | 242/157 R |
| 3,086,722 | 4/1963 | Altice et al. | 242/157 R X |
| 3,576,284 | 4/1971 | Fellous | 226/97 |
| 3,655,862 | 4/1972 | Dorschner et al. | 226/97 X |
| 3,863,309 | 2/1975 | Price | 28/273 |
| 4,095,320 | 6/1978 | Polney | 28/272 X |
| 4,148,116 | 4/1979 | Price | 28/273 X |
| 4,187,593 | 2/1980 | Price | 28/273 X |
| 4,282,637 | 8/1981 | Mosseri et al. | 28/254 |
| 4,295,329 | 10/1981 | Windley | 28/271 X |

FOREIGN PATENT DOCUMENTS

| | | |
|---|---|---|
| 049563 | 8/1981 | European Pat. Off. . |
| 2032855 | 11/1970 | France . |
| 1221912 | 5/1968 | United Kingdom . |
| 1297582 | 9/1970 | United Kingdom . |

*Primary Examiner*—Joseph J. Hail, III
*Assistant Examiner*—Paul T. Bowen
*Attorney, Agent, or Firm*—Birch, Stewart, Kolasch & Birch

[57] ABSTRACT

An air nozzle for use in the production of nonwoven fabric that is adapted to receive spun filaments from a spinning nozzle and feed the filaments in an air jet into a receiver. The air nozzle is directed to the prevention of any abrasion of the inner surface of the nozzle body by an additive, such as titanium white, contained in filaments, and thus to the prevention of any defects in the nonwoven fabric. The inner surface of a nozzle body for guiding filaments is formed using a ceramic material to protect that surface. The nozzle body has a conical passage whose diameter gradually decreases from an inlet for receiving the filaments from the spinning nozzle, and a straight passage continuing from the conical passage and extending with a constant diameter, at least part of the inner surface of the conical passage and/or the straight passage being formed as a ceramic surface.

4 Claims, 2 Drawing Sheets

AIR NOZZLE FOR USE IN PRODUCTION OF NONWOVEN FABRIC

This application is a continuation of application Ser. No. 07/679,150 filed on Mar. 28, 1991 now abandoned, which was a continuation of Ser. No. 07/586,375 filed on Sep. 21, 1990 now abandoned, which was a continuation of Ser. No. 07/304,225 filed on Jan. 31, 1989 now abandoned.

BACKGROUND OF THE INVENTION

The present invention relates to an air nozzle used in the production of nonwoven fabric to cause filaments received from a spinning nozzle to be dispersed and deposited on a screen belt as a receiver and, more specifically, to such an air nozzle directed to the prevention of wear resulting from the high-speed contact of filaments with the nozzle.

A conventional air nozzle of the above-mentioned type is disclosed in, for instance, Japanese Patent Publication No. 28386/1973 which discloses a nonwoven fabric web of continuous filaments and a method of manufacturing the same. As shown in FIG. 4, an air nozzle used in the manufacturing method according to this disclosure comprises a nozzle member 1 for receiving spun filaments from a spinning nozzle (not shown), and a housing 2 disposed on the outside of the nozzle member 1 and provided with a feeding guide tube 2*a*. With this arrangement, filaments are fed in an air jet through the tube 2*a* onto a screen belt (not shown) disposed below the nozzle.

More specifically, the nozzle member 1 has a conical hopper-shaped converging hole 1*a* formed therein and having its diameter gradually decreasing toward the lowermost apex to facilitate the receiving of filaments, and a discharge tube 1*b* projecting from the lowermost apex of the converging hole 1*a* and communicating therewith. The housing 2 also has a compressed air chamber 2*b* and an air throttle portion 2*c* formed therein and surrounding the discharge tube 1*b*. When compressed air A has been introduced into the compressed air chamber 2*b*, the flow of the air A is straightened by the air throttle portion 2*c* and the air A is transformed into an air jet A1 at high speed. The air jet A1 flows on the outer periphery of the discharge tube 1*b* and is blown toward the outlet of the tube 1*b* at the tip thereof. Since negative pressure is caused to prevail in the outlet of the discharge tube 1*b* by the action of the air jet A1, a sucking action is provided to facilitate the discharge of filaments and to stabilize the flow of the filaments being fed. The filaments are guided by the guide tube 2*a*, and are then dispersed and deposited on the screen belt to manufacture nonwoven fabric.

Filaments spun by a spinning nozzle usually contain a pigment such as titanium white ($TiO_2$). Consequently, when filaments containing such a pigment are fed at high speed into an air nozzle, such as that shown in FIG. 4, formed of a stainless steel (e.g., SUS 304), the pigment in the filament acts as an abrasive material as the filaments come into contact with the air nozzle. This results in various problems, such as wear of the inner wall surface of the air nozzle.

The occurrence of such phenomena as wear is particularly serious over the entire region from the lowermost apex of the conical diameter-decreased hole 1*a* across the border 1*c* at which the conical hole 1*a* changes into the straight discharge tube 1*b* to the tip of the discharge tube 1*b*. If wear of the like occurs in this region, this causes, for insance, an increase in resistance to the flow of filaments, thereby making it difficult to achieve uniform dispersion. In such cases, the nonwoven fabric being produced by dispersing and collecting the filaments on the screen belt may become partially defective due to the occurrence of filament overlaps, filament masses, and band-shaped areas of irregular thickness extending in the direction of the flow of the filaments.

Wear and similar phenomena may occur even within a relatively short time of operation. If replacement of a nozzle member 1 has to be frequently performed, frequent stoppages of operation for replacement would lead to an increase in stoppage period and a reduction in production efficiency.

SUMMARY OF THE INVENTION

The present invention has been accomplished in view of the above-stated problems of the prior art. An object of the present invention is to provide an air nozzle for use in the production of nonwoven fabric which is capable of exhibiting, during the production of nonwoven fabric containing a pigment such as titanium white, excellent wear resistance to the pigment, etc.

According to the present invention, there is provided an air nozzle for use in the production of nonwoven fabric adapted to receive spun filaments from a spinning nozzle and feed the filaments in an air jet onto a receiver. The air nozzle comprises a nozzle body having an inlet through which the filaments from the spinning nozzle are receiver, and a passage for guiding air to the periphery of an outlet of the nozzle body at the tip thereof, then for allowing the air to be injected in the direction in which the outlet of the nozzle body is directed, wherein the filaments are discharged from the inside of the nozzle body in the flow of the air in the air passage, then being fed toward the receiver. The nozzle body has a conical passage the diameter of which gradually decreases from the inlet for receiving the filaments, and a straight passage continuing from the conical passage and extending with a constant diameter toward the outlet of the nozzle body, at least part of the inner surface of the conical passage and/or the straight passage being formed as a ceramic surface.

The concept expressed by the statement that the inner surface of the conical passage and/or the straight passage is formed as a ceramic surface includes the formation of the nozzle inner surface as a ceramic surface by forming the entire or part of the nozzle body using a ceramic material and the formation of the nozzle inner surface as a ceramic surface by applying a ceramic coating to the nozzle inner surface.

DESCRIPTION OF THE PREFERRED EMBODIMENTS

Figure 1:
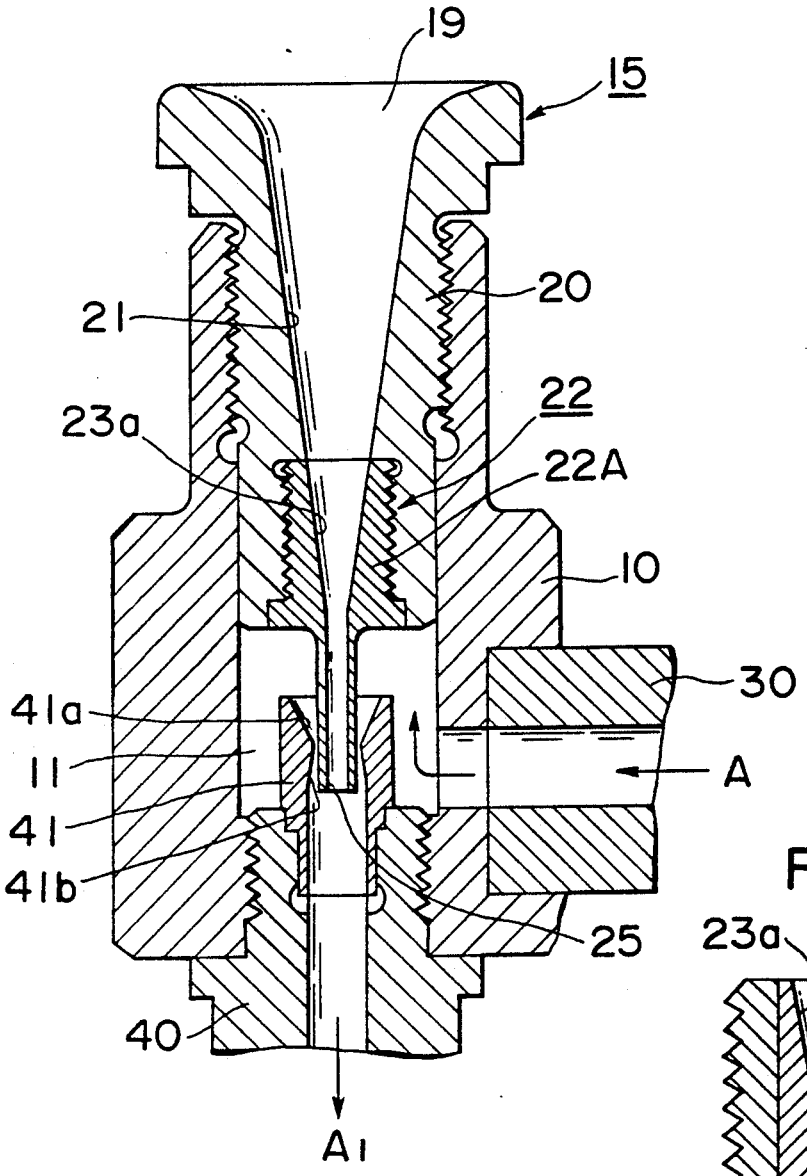
FIG. 1 is a sectional view illustrating one embodiment of the present invention.

One of the most important features of the present invention is that the inner surface of a nozzle body for guiding filaments is formed using a ceramic material to protect the same.

According to this feature, a nozzle body (denoted at 15 in FIG. 1) has a conical passage the diameter of which gradually decreases from an inlet (denoted at 19) through which filaments fed from a spinning nozzle are received, and a straight passage continuing from the conical passage and extending with a constant diameter. According to the present invention, at least part of the inner surface of the conical passage and/or the straight passage is formed as a ceramic surface.

Specifically, this feature may be accomplished in the following manner by way of example:

(1) The entire or part of the nozzle body 15 is formed using a ceramic material. For instance, (i) a part of the nozzle body 15 from a mid-portion of the conical passage to the tip of the straight passage is formed by a mouthpiece 22, while the remaining part is formed by a nozzle base 20, the mouthpiece 22 being detachably mounted on the nozzle base 20, and the entire mouthpiece 22 being formed of a ceramic material; or (ii) a portion of the nozzle body 15 where the conical passage changes into the straight passage is formed as a ceramic formed-body 22C; or (iii) the straight passage is defined by a tube, at least the tip portion of the tube being formed as a ceramic formed-body.

Alternatively, (2) A ceramic coating is applied to at least part of the inner surface of the conical passage and/or the straight passage. For instance, (i) a ceramic coating is applied to the inner surface of a portion where the conical passage changes into the straight passage; or (ii) a ceramic coating is applied to the inner surface of the tip of the straight passage that defines an outlet of the nozzle body; or (iii) a ceramic coating is applied to each of the inner surfaces mentioned at Items (i) and (ii).

The ceramic-surface formation may be carried out in any of the above-described ways. However, it is important that the ceramic material is used to form portions that are vulnerable to wear, such as the corner portion at the boundary between the conical passage and the straight passages, and the inner surface at the tip of the straight passage that defines the outlet of the nozzle body.

Specific descriptions will be given below.

Spinning is performed using a molten resin. The molten resin may preferably be extruded from one or a large number of spinning nozzles arranged in a multiplicity of rows. Filaments spun are fed as they form linear rows spaced at predetermined intervals.

Examples of usable resins may be either crystalline or non-crystalline and they include: polyolefin such as low density polyethylene, high density polyethylene, polypropylene, poly-1-butene, poly-4-methyl-1-pentene or a random or block copolymer of α-olefin which is ethylene, propylene-1-butene, 4-methyl-1-pentene and so on; ethylene vinyl compound copolymer such as ethylene acrylic acid copolymer, ethylene vinyl acetate copolymer, ethylene vinyl alcohol copolymer, ethylene vinyl chloride copolymer; styrene resins such as polystyrene, acrylonitrile-styrene copolymer, ABS, methacrylic acid methyl-styrene copolymer, α-methylstyrene-styrene copolymer; vinyl chloride such as polyvinyl chloride, polyvinylidene chloride, vinyl chloride-vinylidene chloride copolymer; polyacrylic acid ester such as polyacrylic acid methyl and polymethacrylic acid methyl; polyamide such as nylon 6, nylon 6-6, nylon 6-10, nylon 11, nylon 12; thermoplastic polyester such as polyethylene telephthalate, polybutylene telephthalate; polycarbonate; polyphenyleneoxide; and mixtures thereof.

The molten resin contains a suitable amount of a pigment blended therein. Examples of the pigment are inorganic pigments such as titanium white, zinc flower, lithopone, lead white, cadmium yellow, chrome yellow, titan yellow, zinc chromate, yellow ochre, chrome vermilion, orange pigments, amber, yellow iron oxide, red iron oxide, cadmium red, red lead, Prussian blue, ultramarine, cobalt blue, chromium oxide green, mineral violet, carbon black, and iron black; and organic pigments such as benzidine yellow, Hanza yellow, lithol red, alizarin lake, pigment scarlet 3B, brilliant carmine 6B, permanent red F-SR, permanent red 4R, rhodamine lake B, rhodamine lake Y, lake red C, para red, peacock blue lake, phthalocyanine blue, aniline black, permanent yellow HR, PV violet BL, quinacridone, perinone, anthraquinone, chromophthal yellow 6G, chromophthal yellow 3G, and chromophthal yellow GR.

Air nozzles are disposed for receiving bundles of spun filaments and for feeding them onto a receiver, for example, screen belt, and they comprise a plurality of air nozzles the number of which is determined in correspondence with the width of the nonwoven fabric to be produced. Filaments are discharged from each air nozzle as they are carried in air jet. Then, as they are extended and dispersed, the filaments are caused to deposit in an entangled-manner on the screen belt whereby nonwoven fabric of a predetermined size is produced.

In the case where at least the portion of the nozzle body 15 where the conical passage changes into the straight passage is formed as a ceramic surface, the wear resistance of that portion is improved, thereby preventing the occurrence of abrasion in the inner wall surface of the nozzle even when the nozzle is used to receive and feed filaments containing a pigment such as titanium white.

In the case where the nozzle body 15 comprises the nozzle base 20 and the mouthpiece 22, the mouthpiece 22 is disposed at the apex portion of a converging hole 21 of the base 20 where the high-speed contact of filaments with the nozzle base 20 is particularly serious, and a part of a converging passage is defined at that portion by a part of the mouthpiece 22. If a discharge tube portion 22B extending from the converging passage-defining part of the mouthpiece 22 and defining a straight passage is provided in such a manner that the inner peripheral portion at the tip thereof is formed using a ceramic material, the wear resistance of that inner peripheral portion can be improved. In the case being discussed, the manner in which a ceramic surface is provided may be either of the following: the tip portion of the discharge tube portion 22B is formed with a tubular shape using a ceramic material; or a metal material or the like used as a substrate of the discharge tube portion 22B is formed with a tubular shape, then a ceramic coating is applied to the inner peripheral surface at the tip alone. However, the application of a ceramic coating is not limited to the inner periphery at the tip of the discharge tube portion 22B. More preferably, a ceramic coating may be applied to the entire inner periphery of the mouthpiece 22.

Examples of the ceramic material which may be used in the present invention include materials which contain as their main components oxides such as alumina ($Al_2O_3$), boron oxide ($B_2O$), silicon dioxide ($SiO_2$), tin dioxide ($SnO_2$), zinc oxide (ZnO) and zirconium dioxide ($ZrO_2$), nitrides such as boron nitride (BN), aluminum nitride (AlN), silicon nitride ($Si_3N_4$) and sialon [$(Si, Al)_6(O, N)_8$], and carbides such as single-crystal boron carbide ($B_4C$), silicon carbide (SiC) and titanium carbide; and materials which are mixtures thereof.

Among these materials, those containing alumina as their main components have excellent wear resistance, thermal resistance, and chemical resistance, and they are therefore suitable for use in the present invention. A material containing alumina as the main component may be used, for instance, by mixing titanium oxide ($Ti_2O_3$) with alumina ($Al_2O_3$) at the ratio of 0.15:100, adding to the resultant mixture small amounts of chromium oxide ($Cr_2O_3$) and iron oxide ($Fe_2O_3$), and forming the required portion of the mouthpiece 22 by such a method as a rubber pressing method and then sintering the formed body.

If the material contains boron oxide ($B_2O$), this is advantageous in that the oxide has a crystal structure similar to that of diamond, thereby enabling an excellent level of super-hardness and restraining the occurrence of abrasions and marks.

Zirconium dioxide ($ZrO_2$) which has excellent corrosion resistance and wear resistance is also suitable for use in the present invention. Zirconium dioxide may be also used to form a coating on a metal surface. In this case, therefore, instead of using a ceramic material on the portion required, the portion may be coated with a zirconium dioxide coating layer.

Among various types of boron nitride (BN), cubic boron nitride (cBN) has a hardness equivalent to that of diamond and is thus capable of imparting excellent wear resistance. In this regard, boron nitride of this type is also suitable for use in the present invention.

Silicon nitride ($Si_3N_4$) which has excellent wear resistance is also suitable. Silicon nitride may be used by sintering it in a pressurized nitrogen atmosphere together with 3 to 10% of MgO, $Y_2O_3$ and oxides of rare earth metals, which are added as sintering assistants.

Among other examples mentioned above, sialon [$(Si, Al)_6(O, N)_8$], and silicon carbide (SiC) have high levels of hardness, and they are thus suitable for use in the present invention.

An air nozzle for use in the production of nonwoven fabric in accordance with one embodiment of the present invention will now be described hereunder with reference to the drawings.

Referring to FIG. 1, an air nozzle for receiving spun filaments from a spinning nozzle (not shown) has a housing 10, and a nozzle base 20 threaded into the upper portion of the housing 10 and forming a part of a nozzle body 15. Filaments are introduced through an inlet 19 formed in the nozzle base 20. The nozzle base 20 is formed with an inverted-cone shaped converging hole 21 to facilitate the receiving of filaments.

A mouthpiece 22, forming another part of the nozzle body 15, is threaded onto the nozzle base 20 around the periphery of the apex portion of the converging hole 21. The mouthpiece 22 comprises a base portion 22A and a discharge tube portion 22B extending axially from the base portion 22A in the form of a straight tube. The base portion 22A is formed with a converging hole **23*a* continuing from the converging hole 21 of the nozzle base 20 with the same gradient. The discharge tube portion 22B axially project while communicating with the converging hole 23*a*. The converging hole 21 and the converging hole 23*a* constitute a converging passage, while the discharge tube portion 22B** defines a straight passage.

The nozzle base 20 has a compressed air chamber 11 formed therein. The compressed air chamber 11 surrounds that side of the discharge tube portion 22B closer to the nozzle base 20 and acts as a part of an air passage. Compressed air A is introduced into the compressed air chamber 11 from an air supply source (not shown) through an air conduit 30. A feeding guide tube 40, partially defining the compressed air chamber 11, is threaded onto and connected to the lower end of the housing 10, whereby filaments are fed onto a dispersion plate (not shown) disposed below the air nozzle.

An air throttle tube 41 is fitted on the feed guiding tube 40 in such a manner as to project into the compressed air chamber 11. The discharge pipe portion 22B is partially inserted from above into the air throttle tube 41. The air throttle tube 41 is formed with a converging hole **41*a* of which the diameter gradually decreases in the direction of the flow of air, and a diverging hole 41*b* which continues from the converging hole 41*a* and of which the diameter gradually increases. Gaps are provided between the outer periphery of the discharge tube portion 22*b* inserted into the air throttle tube 41 and the inner surfaces of the converging hole 41*a* and the diverging hole 41*b*, to allow passage of compressed air A therethrough. Specifically, the flow of compressed air A from the compressed air chamber 11 is straightened as the air A flows within the air throttle tube 41, and is transformed into an air jet A1 at an increased speed which is blown along the outer periphery of the discharge tube 22B toward the axial tip thereof, and thus into the feeding guide tube 40. The action of the air jet A1 causes negative pressure to prevail in the vicinity of the outer side of the tip of the discharge tube portion 22B**, whereby the flow of the filament being discharged is stabilized through a sucking action.

In this way, filaments discharged from the discharge tube portion 22B of the mouthpiece 22 are carried in an air jet A1 to be passed through the feeding guide tube 40 and then be sent onto the dispersion plate disposed below.

EXAMPLES

Figure 2:
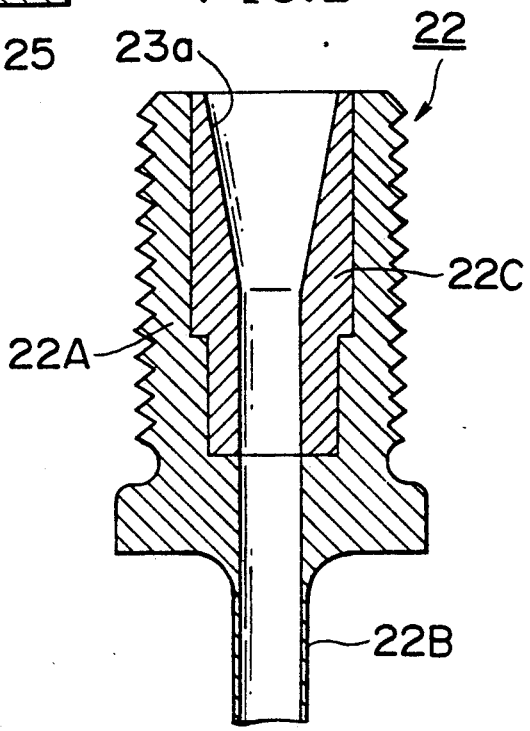
FIG. 2 is a sectional view of a mouthpiece used in another embodiment.
Figure 3:
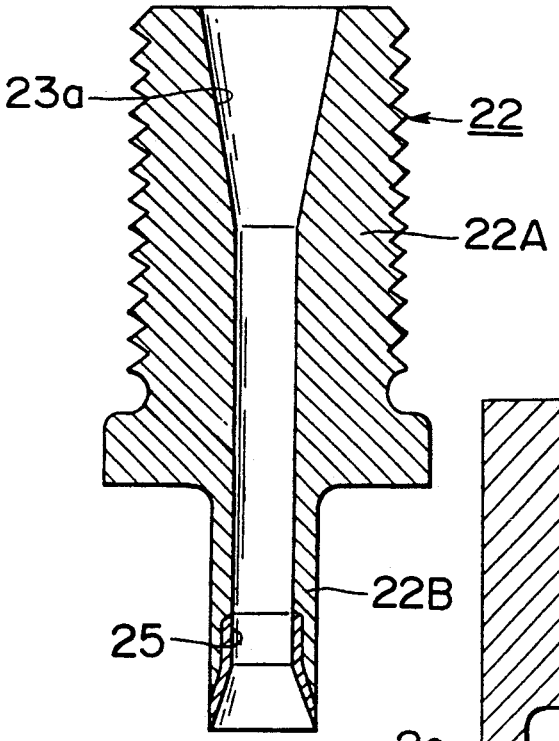
FIG. 3 is a sectional view of a different mouthpiece used in a further embodiment.
Figure 4:
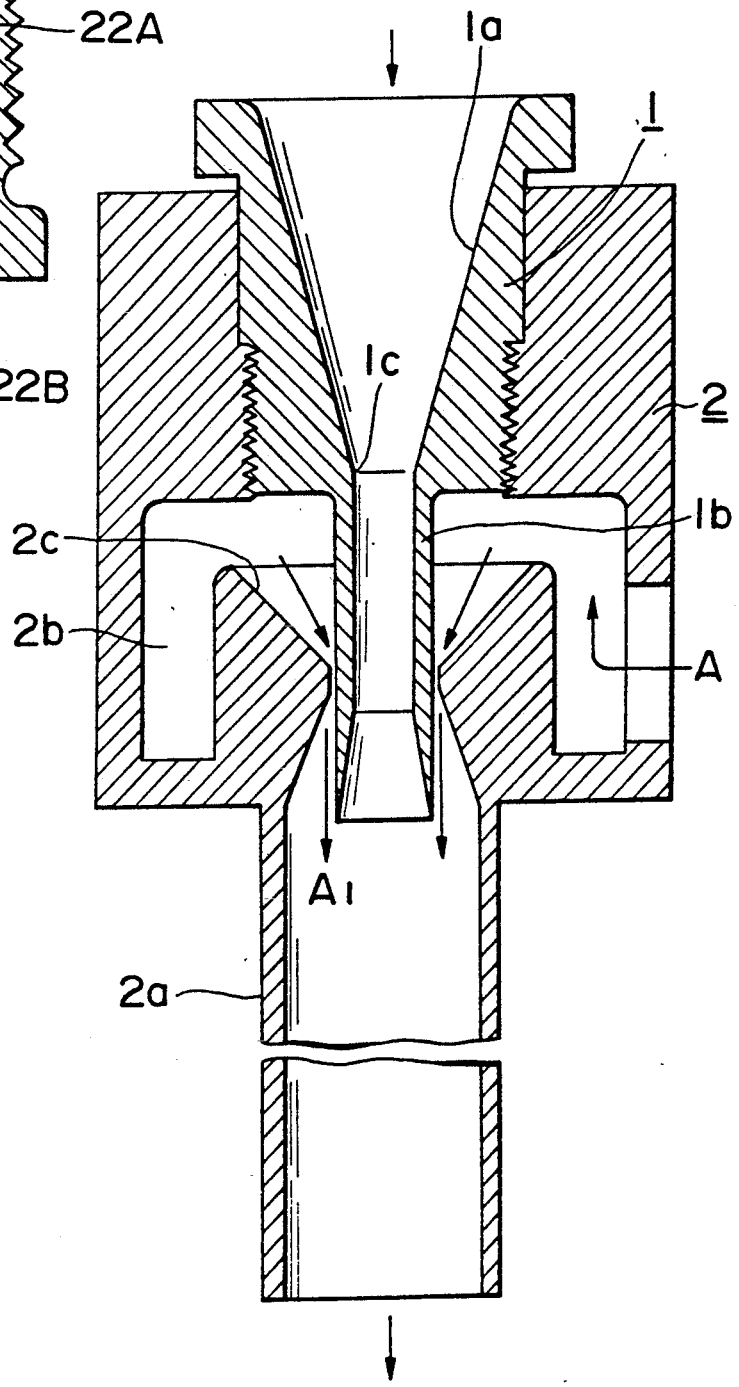
FIG.4 PRIOR ART
FIG. 4 is a sectional view of a conventional air nozzle.

Three types (i), (ii) and (iii) of air nozzles having different mouthpieces were prepared as examples of the air nozzle of the present invention. In the air nozzle type (i), the entire mouth piece 22 was formed using a ceramic material, as shown in FIG. 1; in the air nozzle type (ii), a ceramic formed-body **22*c* was fitted at a portion of the mouthpiece 22 where the converging passage changes into the straight passage, as shown in FIG. 2; and in the air nozzle type (iii), a ceramic coating layer 25 was formed on the inner peripheral surface at the tip portion of the discharge tube portion 22B of the mouthpiece 22, as shown in FIG. 3**. A ceramic material containing alumina as the main component, and comprising, e.g., 100 parts by weight of alumina and 0.1 parts by weight of magnesia was used.

Nonwoven fabric was produced using each type (i), (ii), or (iii) of the air nozzles. Polypropylene was used as the basic material of the nonwoven fabric, 0.85 wt % of titanium white ($TiO_2$) was blended in the material, then spinning was performed. The resultant filaments were dispersed and deposited on a screen belt by means of the air nozzle, thereby attaining a piece of nonwoven fabric. In this production, filaments were dispersed over an elliptic area having a short diameter of 100 mm and a long diameter of 500 to 520 mm. Seven air nozzles of the same type were arranged in a line, and the dispersion plate was moved in the direction in which the air nozzles were arranged, thereby producing a piece of nonwoven fabric having a predetermined thickness.

Further, a different type of air nozzles was prepared as a comparison example and was employed to produce a piece of nonwoven fabric using the same materials and the same method. Each of these air nozzles had a mouthpiece 22' of the same configuration including a discharge tube portion 22B', but the entire mouthpiece 22' was formed of a steel material.

The properties of the pieces of nonwoven fabric produced employing the examples of the present invention and the comparison example were examined. The results of the examination are shown in Table 1.

TABLE 1

| | TIME AFTER PRODUCTION | FILAMENT OVERLAP | FILAMENT MASS | IRREGULAR THICKNESS |
|---|---|---|---|---|
| EXAMPLES OF | IMMEDIATELY AFTER | 1 to 3 | 0 to 2 | 0 |
| INVENTION | 3 DAYS AFTER | 1 to 3 | 0 to 2 | 0 |
| (CERAMIC) | 30 DAYS AFTER | 1 to 3 | 0 to 2 | 0 |
| COMPARISON | IMMEDIATELY AFTER | 2 to 4 | 1 to 3 | 0 |
| EXAMPLE | 3 DAYS AFTER | 7 to 9 | 4 to 6 | 0 to 1 |
| (STEEL) | 7 DAYS AFTER | 30 to 50 | 20 to 30 | 10 to 20 |

The data in the table show the number of occurrence per roll (one roll=0.6 m (width)×5000 m (length)

Filament overlap: a portion of an increased thickness in which filaments overlap with one another and which has a diameter of below 5 cm Filament mass: a portion of an increased thickness in which filaments overlap with one another, and which has a diameter of above 5 cm Irregular thickness: a portion with an irregular thickness which has a length of several mm As will be clearly understood from these results, the air nozzle of the present invention in which a ceramic material is used can ensure that the produced nonwoven fabric has less defectives than that produced employing an air nozzle formed using a steel material, thereby enabling the production of nonwoven fabric having higher qualities.

Production of nonwoven fabric was conducted for one month under the same conditions as those described above and employing the above-described examples of the present invention, and the air nozzles employed were examined. As a result, there was no evidence that any abrasions or marks had occurred in the ceramic-applied portions of the mouthpieces 22. Thus, it has been made clear that with the air nozzle of the present invention, it is possible to continuously produce nonwoven fabric with a very low level of defectiveness.

As has been described above, according to the present invention, it is possible to prevent the inner wall surface of the nozzle body from being abraded and, hence, to prevent the flow of filaments from being disturbed. Accordingly, filaments can be dispersed uniformly without becoming locally deposited, thereby enabling the production of nonwoven fabric with no irregular portions.

What is claimed is:

1. An air nozzle for use in the production of nonwoven fabric adapted to receive spun filaments from a spinning nozzle and feed the filaments in an air jet onto a receiver, comprising:

a) a nozzle body having an inlet through which said filaments from said spinning nozzle are received;

b) an air passage for guiding air to the periphery of an outlet of said nozzle body at the tip thereof, then for allowing the air to be injected in the direction in which said outlet of said nozzle body is directed, wherein said filaments are discharged from the inside of said nozzle body in the flow of said air in said air passage, then fed toward said receiver, said nozzle body having a conical passage the diameter of which gradually decreases from said inlet for receiving said filaments, and a straight passage continuing from said conical passage and extending with a constant diameter toward said outlet of said nozzle body, and a corner portion at a boundary between said conical passage and said straight passage being fitted with a ceramic formed body as an exchangeable element into the boundary and being positioned at the outlet side of the nozzle body; and c) a feeding guide tube having a constant inner diameter connected to the outlet side of said nozzle body, the inner diameter of said feeding guide tube being larger than the outer diameter of the outlet of said nozzle body so as not to disturb an airflow from said air passage.

2. The air nozzle according to claim 1, wherein said ceramic formed body is threadably attached to an interior of said nozzle body.

3. The air nozzle according to claim 1, wherein said ceramic formed body is removably friction fit within an interior of said nozzle body.

4. The air nozzle according to claim 1, wherein said ceramic formed body is formed entirely of a ceramic material.

* * * * *